US006917781B2

(12) United States Patent
Sato

(10) Patent No.: US 6,917,781 B2
(45) Date of Patent: Jul. 12, 2005

(54) DEVELOPER REGULATING MEMBER FOR AN IMAGE FORMING APPARATUS

(75) Inventor: Shougo Sato, Seto (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 114 days.

(21) Appl. No.: 10/377,698

(22) Filed: Mar. 4, 2003

(65) Prior Publication Data

US 2003/0175054 A1 Sep. 18, 2003

(30) Foreign Application Priority Data

Mar. 15, 2002 (JP) ..... 2002-071223

(51) Int. Cl.[7] ..... G03G 15/20
(52) U.S. Cl. ..... 399/284; 399/274
(58) Field of Search ..... 399/274, 284

(56) References Cited

U.S. PATENT DOCUMENTS 5,552,867 A * 9/1996 Sekino et al. ..... 399/284
5,895,150 A * 4/1999 Watabe et al. ..... 399/284
5,978,636 A * 11/1999 Yamamoto et al. ..... 399/284
6,094,555 A * 7/2000 Katoh et al. ..... 399/284
6,128,458 A 10/2000 Sato ..... 399/252
6,256,471 B1 * 7/2001 Sato et al. ..... 399/284
6,259,878 B1 * 7/2001 Sato et al. ..... 399/284
6,456,813 B1 9/2002 Sato ..... 399/284
6,684,047 B2 * 1/2004 Kin et al. ..... 399/284

FOREIGN PATENT DOCUMENTS

JP 61-133952 * 6/1986 ..... G03G/15/08
JP A 2001-318533 11/2001

* cited by examiner

*Primary Examiner*—Fred Braun
(74) *Attorney, Agent, or Firm*—Oliff & Berridge, PLC

(57) ABSTRACT

In an image forming apparatus where toner is supplied to a photosensitive member via a toner supply roller and a developing roller, the toner being charged by the friction contact between toner supply roller and the developing roller, a regulating blade is in contact with the developing roller at a point between contact between the toner supply roller and the developing roller and between the developing roller and the photosensitive member. The area between the contact between the toner supply roller and the developing roller and where the layer regulating blade contacts the developing roller constitutes a first region and the area between the contact between the regulating blade and the developing roller and the developing roller and the photosensitive member constitutes a second region. The charge amount per unit area in the two regions is substantially equal.

21 Claims, 3 Drawing Sheets

DEVELOPER REGULATING MEMBER FOR AN IMAGE FORMING APPARATUS

BACKGROUND OF THE INVENTION

1. Field of Invention

The invention relates to an electrophotographic image forming apparatus.

2. Description of Related Art

A known electrophotographic image forming apparatus employs a nonmagnetic single-component development system. In such an electrophotographic image forming apparatus as disclosed in, for example, U.S. Pat. No. 6,456,813, toner contained in a toner chamber is supplied by an agitator to a supply roller. The toner supplied to the supply roller is then supplied to a developing roller by the rotation of the supply roller. The toner is charged by friction between the supply roller and the developing roller. The toner supplied to a surface of the developing roller enters between the developing roller and a layer thickness regulating blade, as the developing roller rotates. The toner is sufficiently charged between the layer thickness regulating blade and the developing roller, and is formed into a uniform-thickness thin layer on the developing roller.

The toner carried as a thin layer on the surface of the developing roller is attached to an electrostatic latent image formed on a surface of a photosensitive drum, to form a visible toner image. The toner attached to the photosensitive drum is transferred onto a sheet by a transfer roller. Thus, an image is formed onto the sheet.

When the toner is rubbed between the layer thickness regulating blade and the developing roller, the toner is charged. At the same time, the toner is formed into the thin layer. As the toner is thus charged, the regulating blade accumulates thereon a charge with a polarity opposite to that of the toner. Such a charge opposite in polarity to the toner that has been charged with the proper polarity, is referred to as a countercharge. Due to the countercharge, the toner is attracted to the regulating blade. Accordingly, the properly charged toner cannot pass by the regulating blade.

The toner that happens to be charged with a reverse polarity, readily passes by the regulating blade due to the countercharge. This causes a deterioration in image quality. The countercharge accumulated on the regulating blade may be passed to the toner with poor charging performances, leading to unstable thin toner layer formation, as well as unstable toner charging.

The regulating blade may be firmly pressed against the developing roller, to increase frictional force and to frictionally charge the toner. However, this arrangement may cause the regulating blade to be worn quickly, leading to a deterioration in image quality.

SUMMARY OF THE INVENTION

The invention is directed to an image forming apparatus having a photosensitive member that carries a latent image, a developing agent carrier that carries toner, or developing agent, to the photosensitive member, a toner supply roller that supplies the toner to the developing roller and a regulating member that contacts the developing roller and allows toner to pass therebetween to form a thin layer on the developing roller. The regulating member comprises a layer thickness regulating plate which has a spring plate member and a pressing portion. At the upstream end of the pressing portion is a guide portion that provides a gradually decreasing space directing the toner into contact with the developing roller. The position of the regulating member divides the portion of the developing roller between contact with the toner supply roller and contact with the photosensitive member into two regions. The first region is from the contact with the toner supply roller to the point where pressing portion of the layer thickness regulating plate contacts the developing roller and the second portion is from that point of contact to the point where the developing roller is in contact with the photosensitive member. A charge amount per unit area of the toner, or developing agent, in the first region is substantially equal to a charge amount per unit area of the toner in the second region.

BRIEF DESCRIPTION OF THE DRAWINGS

An embodiment of the invention will be described in detail with reference to the following figures wherein.

DETAILED DESCRIPTION OF PREFERRED EMBODIMENTS

Figure 1:
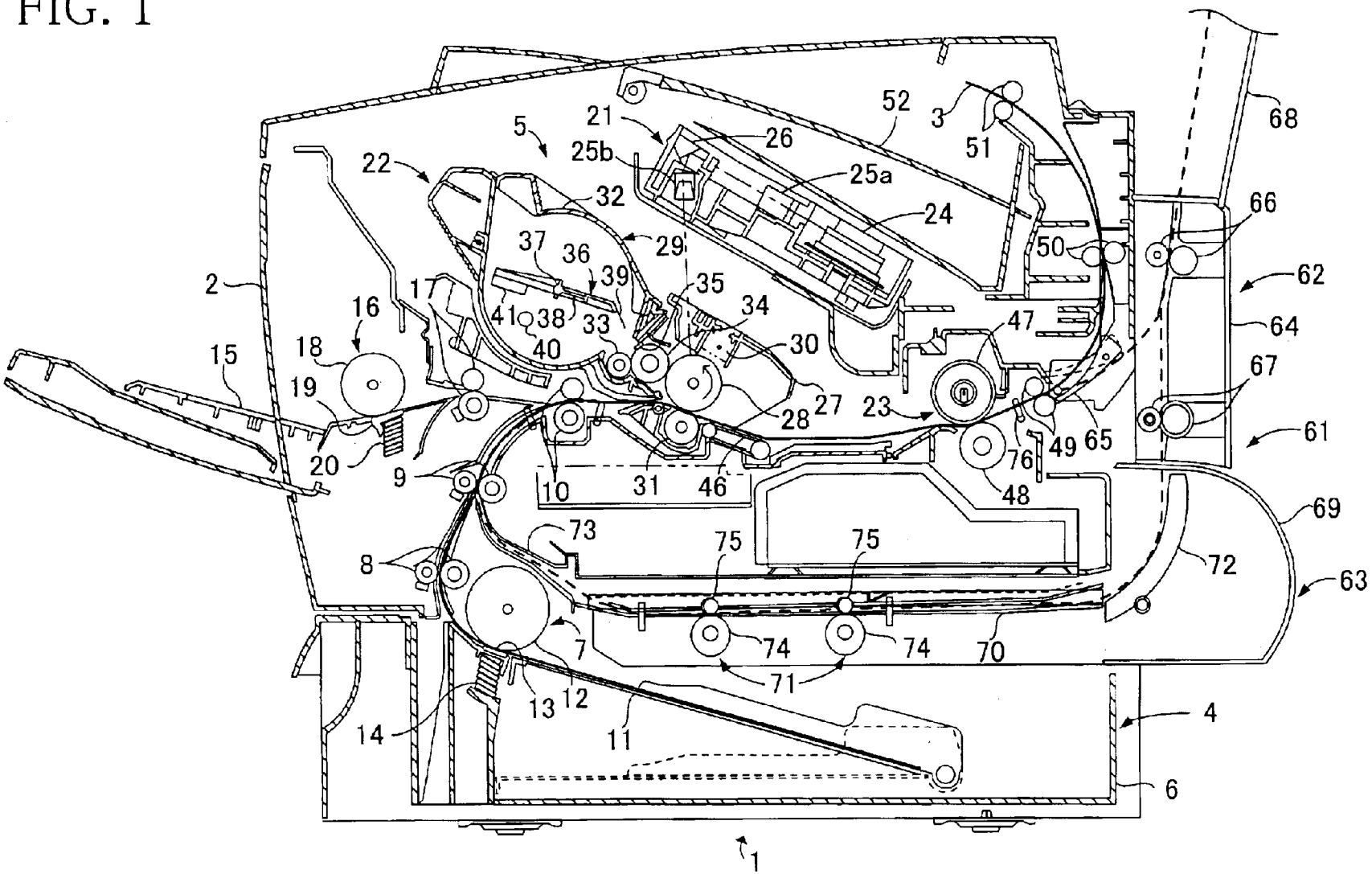
FIG. 1 is a side cross sectional view showing an essential portion of a laser printer, according to an embodiment of the invention.

FIG. 1 shows a laser printer 1 embodying an image forming apparatus of the invention. The laser printer 1 is an electrophotographic printer that forms an image in a nonmagnetic single-component development system.

As shown in FIG. 1, the printer 1 includes a main casing 2, a feeder section 4 for feeding a paper sheet 3, and an image forming section 5 for forming an image on the fed sheet 3. The feeder section 4 and the image forming section 5 are installed in the casing 2.

The feeder section 4 includes a sheet supply tray 6 removably set on a bottom of the main casing 2, a sheet supply portion 7 disposed at one side of the sheet supply tray 6, first and second conveying rollers 8, 9 disposed at a downstream side of the sheet supply portion 7 in a sheet feeding direction, and register rollers 10 disposed downstream of the first and second conveying rollers 8, 9.

The sheet supply tray 6 is of a box shape with an upper open construction so as to accommodate therein a stack of sheets 3. The sheet supply tray 6 is slidable with respect to the bottom of the main casing 2, so that the tray 6 can be set into or detached from the casing 2. A sheet mount plate 11 is provided in the sheet supply tray 6 so as to allow the sheets 3 to be stacked on the sheet mount plate 11. The sheet mount plate 11 pivots on one end far from the sheet supply portion 7, so that the other end of the sheet mount plate 11 near the sheet supply portion 7 is movable in a vertical direction. Disposed on the underside of the sheet mount plate 11 is a spring (not shown) that urges the sheet mount plate 11 upwardly. As the amount of the sheets 3 stacked on the sheet mount plate 11 increases, the sheet mount plate 11 pivots downward about the one end far from the sheet supply portion 7, against an urging force of the spring.

The sheet supply portion 7 includes a pick-up roller 12, a separation pad 13 disposed to face the pick-up roller 12, and a spring 14 disposed at the underside of the separation pad 13. The separation pad 13 is pressed against the pick-up roller 12 by an urging force of the spring 14.

An uppermost sheet 3 on the sheet mount plate 11 is pressed toward the pick-up roller 12 by the spring disposed on the underside of the sheet mount plate 11. As the pick-up roller 12 rotates, a leading end portion of the uppermost sheet 3 is nipped between the pick-up roller 12 and the separation pad 13. In this manner, the uppermost sheet 3 is separated from the sheet stack. The separated sheet 3 is delivered to the conveying rollers 8, 9 and then to the register rollers 10.

The register rollers 10 comprise a pair of rollers. The register rollers 10 register or correct the orientation of the sheet 3, and then feed the sheet 3 to an image forming portion.

The feeder section 4 further includes a multi-purpose tray 15 on which any size of sheets 3 are mountable, a multi-purpose sheet supply portion 16 that feeds the sheets 3 mounted on the multi-purpose tray 15, and a pair of multi-purpose transferring rollers 17. A stack of any sizes of sheets 3 is mountable on the multi-purpose tray 15.

The multi-purpose sheet supply portion 16 includes a multi-purpose pick-up roller 18, a multi-purpose separation pad 19 disposed to face the multi-purpose pick-up roller 18, and a spring 20 disposed on the underside of the multi-purpose separation pad 19. The multi-purpose separation pad 19 is pressed against the multi-purpose pick-up roller 18 by an urging force of the spring 20.

A leading end portion of an uppermost sheet 3 on the multi-purpose tray 15 is nipped between the multi-purpose pick-up roller 18 and the multi-purpose separation pad 19, as the multi-purpose pick-up roller 18 rotates. In this manner, the uppermost sheet 3 is separated from the sheet stack on the tray 15. The separated sheet 3 is delivered to the multi-purpose transferring rollers 17 and then to the register rollers 10.

The image forming section 5 includes a scanner unit 21, a process unit 22, and a fixing unit 23. The scanner unit 21 is provided in an upper portion of the main casing 2. The scanner unit 21 includes a laser emitting portion (not shown), a polygon mirror 24 that is driven to spin, lenses 25*a*, 25*b*, and reflecting mirror 26. A laser beam, modulated based on image data, is emitted from the laser emitting portion. The laser beam emitted from the laser emitting portion passes through or reflects off the polygon mirror 24, the lens 25*a*, the reflecting mirror 26, and the lens 25*b* in that order, as indicated by broken lines in FIG. 1, to irradiate a surface of a photosensitive drum 28 with the laser beam. The photosensitive device 28 will be described below in more detail.

Figure 2:
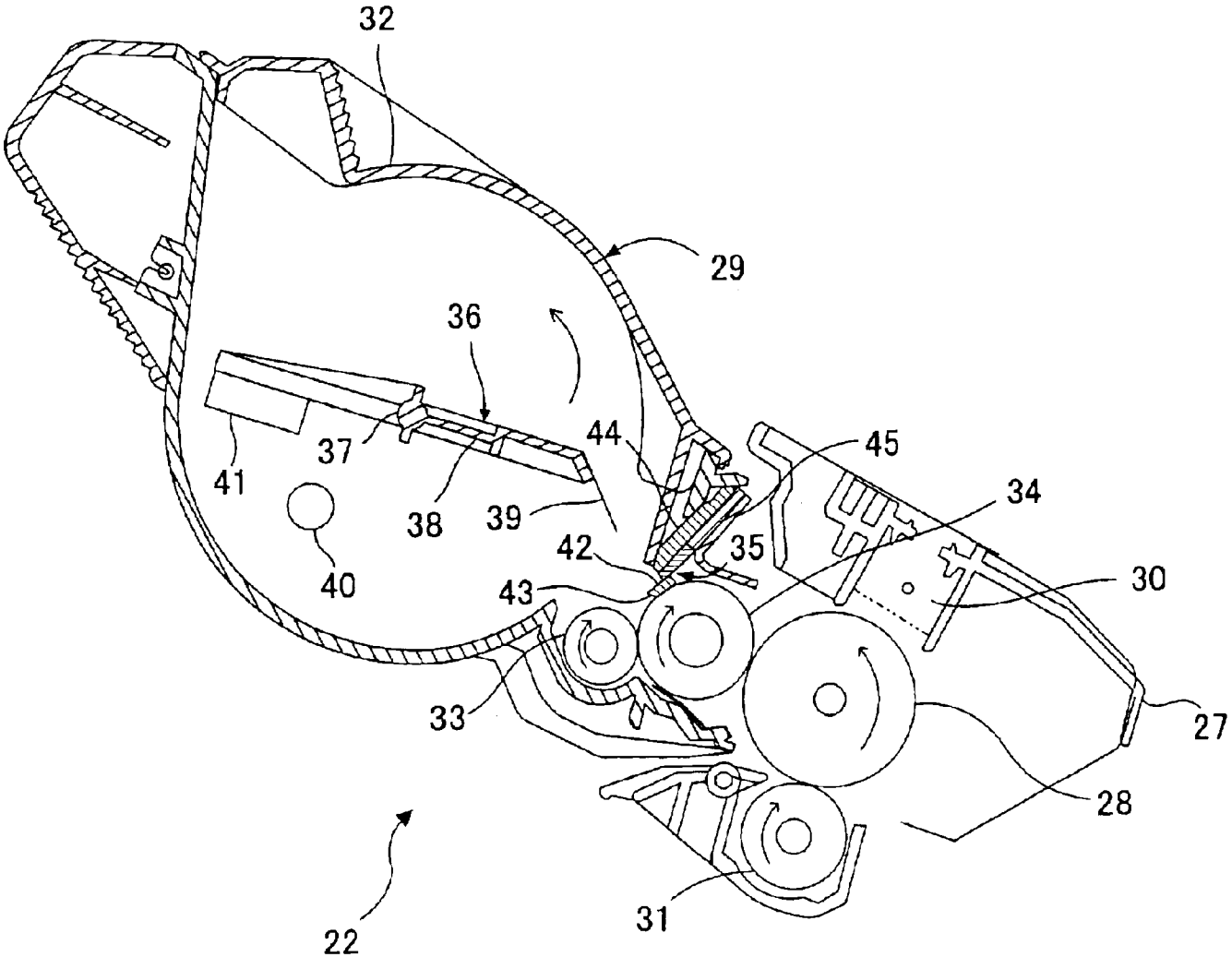
FIG. 2 is a side cross sectional view showing an essential portion of a process unit of the laser printer shown in FIG. 1.

The process unit 22 is disposed below the scanner unit 16. The process unit 22 is removably set into the main casing 2. As shown in FIG. 2, the process unit 22 includes a photosensitive member cartridge 27 and a developing cartridge 29 detachably mounted on the photosensitive member cartridge 27. The photosensitive member cartridge 27 includes the photosensitive drum 28, a scorotron charger 30, and a transfer roller 31. The developing cartridge 29 includes a toner hopper 32, a toner supply roller 33 disposed to one side of the toner hopper 32, a developing roller 34, and a layer thickness regulating blade 35.

The toner hopper 32 accommodates positively chargeable non-magnetic single component toner. The toner is, for example, polymerized toner that is obtained by copolymerizing polymerizable monomers using a known polymerization method, such as a suspension polymerization method. The polymerizable monomers may be styrene-based monomers, such as styrene, and acrylic-based monomers, such as acrylic acid, alkyl (C1–C4) acrylate, and alkyl (C1–C4) methacrylate.

Polymerized toner particles are spherical in shape, having excellent fluidity. Toner particle sizes are approximately 6 to 10 $\mu$m. The toner is mixed with a coloring material, such as carbon black, and wax, as well as an external additive, such as silica, to improve the fluidity of the toner.

The toner further includes a positively chargeable charge control agent, such as nigrosine, triphenylmethane, and quaternary ammonium salt. The charge control agent is dispersed over a surface of a toner base particle, so that chargeability of the toner is improved.

The charge control agent may be dispersed over the surface of the toner base particle using the following methods. For example, using Mechanofusion AMS manufactured by Hosokawa Micron Corporation, the charge control agent is pulverized and classified to fuse the charge control agent over the surface of the toner base particle. Thereafter, the external additive, such as silica, is added.

In another method to disperse the charge control agent over the surface of the toner base particles, resin and the charge control agent, such as styrene-acrylic-based charge control resin having a quaternary ammonium salt group in its side chain, may be polymerized to the surface of the polymerized toner obtained by copolymerization. The styrene-acrylic-based charge control resin having a quaternary ammonium salt group in its side chain is favorably polymerized with the polymerized toner.

An agitator 36 is disposed in the toner hopper 32 to agitate the toner. The agitator 36 includes a rotating shaft 37 that is rotatably supported in a substantially central portion of the toner hopper 32, a blade 38 that extends from the rotating shaft 37, and a film 39 disposed at a free end of the blade 38. As the rotating shaft 37 rotates counterclockwise as indicated by the arrow, the blade 38 is moved in a circumferential direction and the film 39 scoops up the toner in the toner hopper 32, to supply the toner to the toner supply roller 33. Also, provided on the rotating shaft 37 of the agitator 36, on the opposite side of the blade 38, is a cleaner 41 that cleans a residual toner amount detecting window 40 provided on a side wall of the toner hopper 32.

The toner supply roller 33 is rotatably disposed to one side of the toner hopper 32. The supply roller 33 is rotatable, as indicated by the arrow in FIG. 2, in the clockwise direction, which is opposite to a rotating direction of the agitator 36. The toner supply roller 33 includes a metal roller shaft covered by a roller portion formed of conductive urethane sponge.

The developing roller 34 is rotatably disposed so as to face the toner supply roller 33. The developing roller 34 is rotatable, as indicated by the arrow in FIG. 2, in the same direction as the toner supply roller 33. The developing roller 34 includes a metal roller shaft covered by a roller portion formed of a conductive elastic material. More specifically, the roller portion of the developing roller 34 is formed of conductive urethane rubber or silicone rubber including fine carbon particles. A surface of the roller portion of the developing roller 34 is coated with urethane rubber or silicone rubber including fluorine. A predetermined development bias is applied to the developing roller 34, to establish an electric field between the developing roller 34 and the photosensitive drum 28.

The toner supply roller 33 and the developing roller 34 are disposed in confrontation with each other. The toner supply roller 33 and the developing roller 34 contact each other so as to apply some pressure to each other. As shown in FIG.

3, at a contacting portion where the toner supply roller 33 and the developing roller 34 contact each other, the toner supply roller 33 moves from the upward direction to the downward direction. At the contacting portion, the developing roller 34 moves from the downward direction to the upward direction. In other words, the toner supply roller 33 and the developing roller 34 move in opposite directions at their contacting portion.

The rotating speed of the toner supply roller 33 is more than twice as fast as that of the developing roller 34. More specifically, the circumferential velocities of the developing roller 34 and the toner supply roller 33 are set to, for example, approximately 200 mm/sec and 400 mm/sec, respectively.

To set the different rotating speeds for the developing roller 34 and the toner supply roller 33, drive motors for driving the developing roller 34 and the toner supply roller 33 may be separately provided and different drive speeds may be set. Instead, drive gears for the developing roller 34 and the toner supply roller 33 may be controlled using one motor such that the developing roller 34 and the toner supply roller 33 rotate at different speeds.

The layer thickness regulating blade 35 is disposed between positions, in the rotating direction of the developing roller 34, where the developing roller 34 faces the toner supply roller 33 and where the developing roller 34 faces the photosensitive drum 28. The regulating blade 35 is provided along an axis of the developing roller 34 so as to face the developing roller 34.

Figure 3:
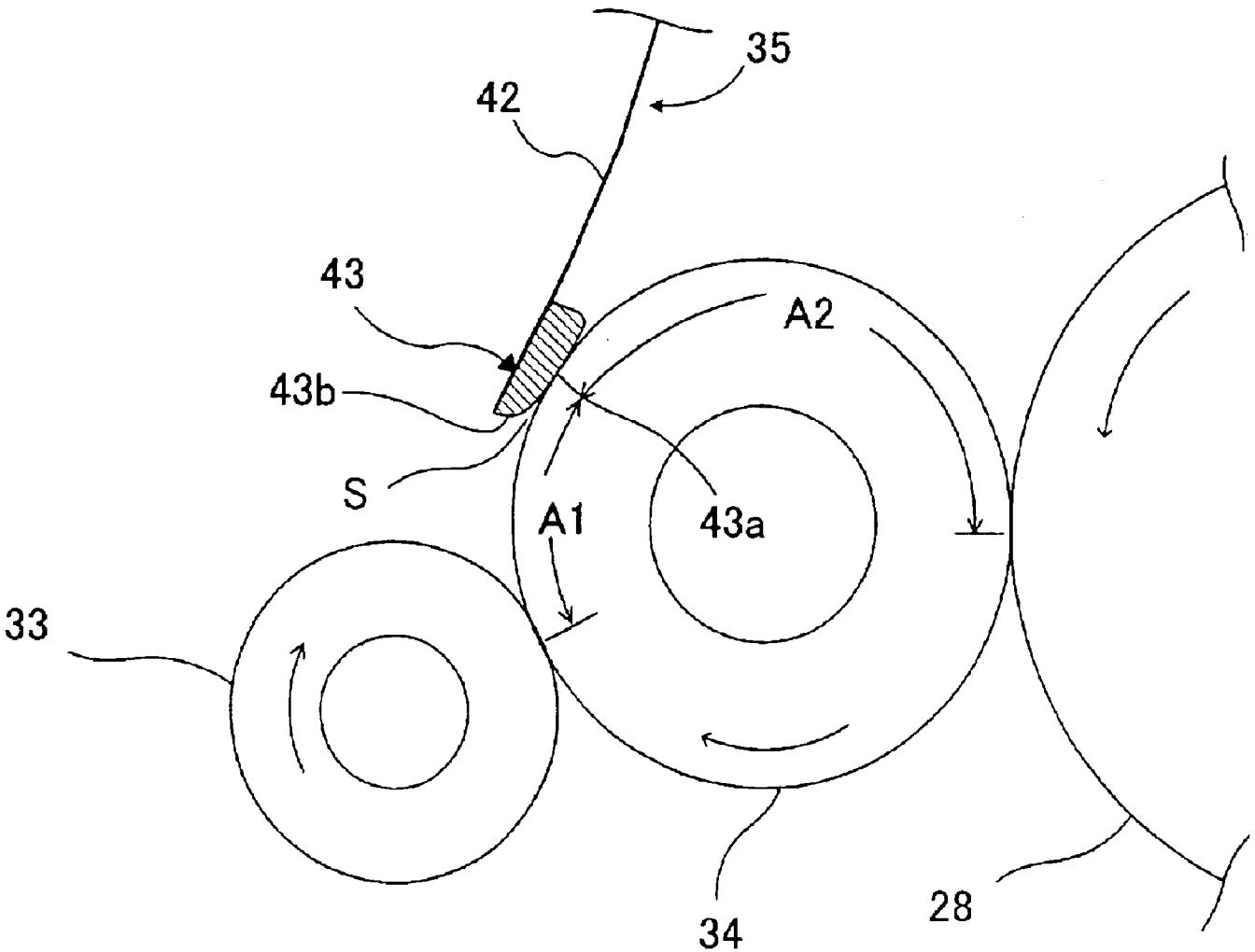
FIG. 3 is an enlarged cross sectional view showing an essential portion of the process unit shown in FIG. 2.

As shown in FIGS. 2 and 3, the regulating blade 35 includes a plate spring member 42, a pressing portion 43 attached to one end of the plate spring member 42 so as to contact the developing roller 34 and formed of insulating silicone rubber, a backup member 44 disposed at a rear side of the plate spring member 42, and a supporting member 45 that supports the other end of the plate spring member 42 in the developing cartridge 29.

The regulating blade 35 is fixedly disposed with the other end of the plate spring member 42 being supported by the supporting member 45 in the developing cartridge 29. The pressing portion 43 presses the surface of the developing roller 34 at a low pressure provided by the elasticity of the plate spring member 42.

More specifically, as shown in FIG. 3, the pressing portion 43 of the regulating blade 35 has a substantially rectangular cross-sectional shape. The pressing portion 43 includes a contact portion 43*a* that contacts the developing roller 34, and a guide portion 43*b* that is formed continuously with the contact portion 43*a*. The contact portion 43*a* has a substantially flat surface, which contacts the surface of the developing roller 34. The guide portion 43*b* is disposed on an upstream side of the contact portion 43*a* in the rotating direction of the developing roller 34, and is formed continuously and integrally with the contact portion 43*a*. A surface of the guide portion 43*b* is curved from the flat surface of the contact portion 43*a* toward the plate spring member 42. The surfaces of the guide portion 43*b* and the developing roller 34 define a space S of a substantially "V" shape in cross section.

As shown in FIG. 2, the toner in the toner hopper 32 is stirred as the agitator 36 rotates, and is supplied to the toner supply roller 33. As the agitator 36 rotates, the cleaner 41 cleans the residual toner amount detecting window 40.

The toner supplied to the toner supply roller 33 is then supplied to the developing roller 34, by the rotation of the toner supply roller 33. As described above, the toner supply roller 33 and the developing roller 34 move in the opposite directions at their contacting portion, and the rotating speed of the toner supply roller 33 is set to more than twice as fast as that of the developing roller 34. With such a structure, the toner is rubbed strongly between the toner supply roller 33 and the developing roller 34 when the toner is supplied from the toner supply roller 33 to the developing roller 34. Thus, the toner is positively and sufficiently charged.

Especially, the roller portion of the toner supply roller 33 is formed of the urethane sponge, which has relatively low rigidity. Therefore, the frictional force exerted between the toner supply roller 33 and the toner is relatively low, and the degree of charging by friction therebetween can be greatly lowered. The toner directly contacting the developing roller 34, whose roller portion is formed of an elastic material having relatively high rigidity, is sufficiently charged by the friction between the developing roller 34 and the toner. Consequently, only the sufficiently charged toner is carried onto the surface of the developing roller 34.

The charge control agent is dispersed over the surface of the toner base particle, so that the toner can be effectively charged. The polymerized toner whose particles are substantially spherical in shape is used. Therefore, the toner particles flow smoothly and are uniformly charged. Thus, charging performance is improved.

The charged toner is carried onto the surface of the developing roller 34, and enters between the developing roller 34 and the pressing portion 43 of the regulating blade 35, as the developing roller 34 rotates. At the time when the toner enters between the developing roller 34 and the pressing portion 43, the toner is first guided smoothly to the space S by the guide portion 43*b* of the pressing portion 43, and then to the contact portion 43*a*.

When the toner passes between the developing roller 34 and the contact portion 43*a*, excessive toner, which is not directly carried onto the surface of the developing roller 34, is smoothly scraped off and a thin layer of toner is formed on the surface of the developing roller 34.

More specifically, the pressing portion 43 contacting the developing roller 34 at a low pressure forms the space S. Due to the space S, the suitably charged toner directly carried on the surface of the developing roller 34 is prevented from being scraped off. Only the toner that is not charged well or not directly carried on the surface of the developing roller 34 is scraped off by the pressing portion 43.

Excess toner or the toner that is not directly carried on the surface of the developing roller 34, is toner that is not charged sufficiently or undercharged toner. More specifically, the toner is supplied to the developing roller 34 from the toner supply roller 33 but a large amount of the toner is not sufficiently charged by friction between the toner supply roller 33 and the developing roller 34 because the toner does not make contact with the surface of the developing roller 34. Such undercharged toner is only delivered to the regulating blade 35, according to the rotation of the developing roller 34, and is eventually scraped off by the pressing portion 43 of the regulating blade 35 because the toner is not directly carried on the surface of the developing roller 34.

As described above, the coating layer formed on the roller portion of the developing roller 34 includes fluorine. The coating layer including fluorine has a lower friction coefficient. Therefore, it is difficult for the coating layer to carry thereon the toner which is not sufficiently charged.

More specifically, the toner that is not sufficiently charged is readily scraped off by the pressing portion 43. Only the sufficiently charged toner passes through the pressing portion 43 and is carried on the developing roller 34.

With the above-described structure, when the toner is supplied from the toner supply roller 33 to the developing roller 34, the toner is rubbed therebetween and the charge amount reaches a level of saturation. Therefore, the toner is not substantially charged when the toner enters between the developing roller 34 and the pressing portion 43.

As shown in FIG. 3, a first area A1 is defined between positions in the rotating direction of the developing roller 34 where the developing roller 34 faces the toner supply roller 33 and where the developing roller 34 faces the regulating blade 35. A charge amount per unit area of a thin layer of toner, which is supplied to the surface of the developing roller 34 in the first area A1, is referred to as the charge amount Q1 at the first area A1. The charge amount per unit area of a thin layer of toner will hereinafter be referred to as Q/A.

A second area A2 is defined between positions in the rotating direction of the developing roller 34 where the developing roller 34 faces the regulating blade 35 and where the developing roller 34 faces the photosensitive drum 28. The charge amount per unit area of a thin layer of toner, which is supplied to the surface of the developing roller 34 in the second area A2, is referred to as the charge amount Q2 at the second area A2.

Assuming that a solid black image is formed (a solidly shaded visible image formed on the photosensitive drum 28 in the entire image forming area thereof is developed), the charge amounts Q1, Q2 after such image formation satisfy the following formula.

$$Q1 \leqq Q2 < 1.2 \times Q1 \quad (1)$$

The charge amount Q2 in the second area A2 falls within a range where the charge amount Q2 is equal to or greater than the charge amount Q1 but does not exceed 1.2 times the charge amount Q1.

When the solid black image is formed, an electrostatic latent image is formed on a whole specific area of the photosensitive drum 28. In this case, the toner carried on a specific surface area of the developing roller 34 is attached to the electrostatic latent image, so that substantially no toner is left on the surface of the developing roller 34.

Thereafter, the toner is again supplied by the toner supply roller 33. The toner is charged by friction between the developing roller 34 and the toner supply roller 33. The sufficiently charged toner is formed into a thin layer on the surface of the developing roller 34 by the regulating blade 35. In this state, the charge amounts Q1, Q2 satisfy the above-described formula (1).

The charge amount Q2 is considered as a saturated charge amount of toner, which accepts no further charging. The formula (1) indicates that the charge amount Q1 of toner that is rubbed between the toner supply roller 33 and the developing roller 34, is at least 1/1.2 times the saturated charge amount (Q2), that is, approximately a little more than 83%. In other words, the amount of toner charge applied by the regulating blade 35 is less than 20% of the charge amount Q1 at the first area A1.

Assuming that a solid white image is formed (no visible image on the photosensitive drum 28 in the entire image forming area thereof is developed), the charge amounts Q1, Q2 after such image formation satisfy the following formula.

$$Q2 \leqq Q1 < 1.2 \times Q2 \quad (2)$$

The charge amount Q1 in the first area A1 falls within a range where the charge amount Q1 is equal to or greater than the charge amount Q2 but does not exceed the 1.2 times the charge amount Q2.

When the solid white image is formed, no electrostatic latent image is formed on a specific area of the photosensitive drum 28. In this case, the charged toner carried on the surface of the developing roller 34 stays on the developing roller 34, without being transferred to the photosensitive drum 28.

Thereafter, even when the toner is again supplied by the toner supply roller 33, the newly supplied toner is scraped off by the regulating blade 35. In this state, the charge amounts Q1, Q2 satisfy the above-described formula (2).

In this case, the toner at the first area A1 has rotated once while being carried on the developing roller 34 during the solid white image formation. Therefore, the charge amount Q1 at the first area A1 has already reached the level of saturation. The toner whose charge amount has reached the level of saturation, is possibly scraped off slightly by the regulating blade 35. As a result, the charge amount Q2 at the second area A2 is at least 1/1.2 times the charge amount Q1 at the first area A1. That is, the amount of toner left on the first area A1 is at least 1.2 times as much as that of toner on the second area A2. Preferably, the charge amounts Q1, Q2 at the first and the second areas A1, A2 are substantially the same.

The charge amount per unit area of a thin layer of toner (Q/A) can be obtained in the following manner. First, the toner carried on the first area A1 or the second area A2 of the developing roller 34 is collected using, for example, a sucker. The charge amount of the collected toner is measured using, for example, a Faraday gauge. In order to obtain the area of the toner sucked portion, a strip of mending tape (manufactured by 3M) is attached to the surface of the developing roller 34 where the toner has been sucked. Then, the strip of the tape is removed. The area of the portion where the toner is unattached to the strip of the tape is measured. Based on the charge amount measured by the Faraday gage and the area of the toner sucked portion, the charge amount per unit area of a thin layer of toner (Q/A) is obtained.

In the first area A1, a larger amount of the toner is carried onto the developing roller 34. However, the toner deposited away from the surface of the developing roller 34 is not sufficiently charged, and does not affect the measurement of the charge amount per unit area of a thin layer of toner (Q/A).

As shown in FIG. 2, the photosensitive drum 28 is provided to a side of the developing roller 34, in confrontation therewith. The photosensitive drum 28 is supported in the photosensitive member cartridge 27 so as to rotate in the counterclockwise direction as indicated by the arrow. The photosensitive drum 28 includes an aluminum cylindrical drum that is grounded, and a positively chargeable photosensitive coating layer that is made from polycarbonate and formed on the surface of the aluminum cylindrical drum.

The scorotron charger 30 is supported in the photosensitive member cartridge 27 above the photosensitive drum 28 with a predetermined distance therebetween, to prevent the scorotron charger 30 from contacting the photosensitive drum 28. The scorotron charger 30 generates corona discharge from a charging wire made from tungsten, and uniformly and positively charges the surface of the photosensitive drum 28.

The surface of the photosensitive drum 28 is uniformly and positively charged by the scorotron charger 30 while the photosensitive drum 28 rotates. As the surface of the photosensitive drum 28 is selectively exposed to the laser beam emitted from the scanner unit 21 based on image data, the charge at an area exposed with the laser beam is removed. Thus, an electrostatic latent image is formed on the surface of the photosensitive drum 28.

Thereafter, in accordance with the rotation of the developing roller 34, the toner, which is carried on the developing roller 34 and is positively charged, is deposited on the electrostatic latent image formed on the photosensitive drum 28, thereby making the image visible.

The transfer roller 31 is positioned below the photosensitive drum 28 in confrontation therewith. The transfer roller 31 is supported in the photosensitive member cartridge 27 so as to rotate clockwise, as indicated by the arrow. The transfer roller 31 includes a metal roller shaft covered by a roller portion formed of a conductive rubber material. A predetermined transfer bias is applied to the transfer roller 31, to establish an electric field between the transfer roller 31 and the photosensitive drum 28, when the toner is transferred from the photosensitive drum 28 to the sheet 3.

The sheet 3 registered and fed by the register rollers 10 passes between the photosensitive drum 28 and the transfer roller 31, as the photosensitive drum 28 rotates and the toner carried on the surface of the photosensitive drum 28 comes to a position to face the transfer roller 31. The visible toner image formed on the photosensitive drum 28 is transferred onto the sheet 3, due to the transfer bias applied to the transfer roller 31. Then, the sheet 3 is delivered to the fixing unit 23 through a transport belt 46, as shown in FIG. 1.

The fixing unit 23 is disposed downstream of the process unit 22 in the sheet feeding direction. The fixing unit 23 includes a heat roller 47, a pressure roller 48, and feed rollers 49. The heat roller 47 is formed of aluminum into a cylindrical shape and is provided therein with a halogen lamp. The pressure roller 48 is disposed below the heat roller 47, so as to press against the heat roller 47. The feed rollers 49 are disposed downstream of the heat roller 47 and the pressure roller 48 in the sheet feeding direction.

When the sheet 3 having the toner image transferred thereon passes through the heat roller 47 and the pressure roller 48, the toner is thermally fixed to the sheet 3 by the heat applied by the heat roller 47. The sheet 3 is then delivered by way of the feed rollers 49 to downstream-side feed rollers 50 and discharge rollers 51 disposed in the main casing 2.

The feed rollers 50 are disposed downstream of the feed rollers 49 in the sheet feeding direction. The discharge rollers 51 are disposed above a discharge tray 52. The sheet 3 delivered by the feed rollers 49 is then fed by the downstream-side feed rollers 50 to the discharge rollers 51. The sheet 3 fed by the discharge rollers 51 is discharged onto the discharge tray 52.

Residual toner remaining on the surface of the photosensitive drum 28, after the toner is transferred to the sheet 3, is collected by the developing roller 34. In this toner collection manner, a device for wiping off the residual toner from the developing roller 34, such as a blade and a residual toner container can be dispensed with, to simplify an overall arrangement of the laser printer 1.

A sheet re-circulation unit 61 is provided in the laser printer 1 for forming images on both surfaces of the sheet 3. The re-circulation unit 61 includes a sheet reverse section 62 and a re-circulation tray 63 (in this embodiment). The re-circulation unit 61 is positioned at a rear wall of the main casing 2 in such a manner that the sheet reverse section 62 is attached beside the rear wall, and the re-circulation tray 63 is detachably inserted into the rear wall at a position above the sheet supply tray 6 of the feeder section 4.

The sheet reverse section 62 has a casing 64 having generally a rectangular cross section and attached to the rear wall of the main casing 2. In the casing 64, reverse rollers 66 and re-circulation rollers 67 are provided. Further, a reverse guide plate 68 extends upwardly from an upper end portion of the casing 64.

Disposed at a downstream side of the feed rollers 49 is a flapper 65 for switching a feeding direction of the one-sided image carrying sheet 3 fed by the feed rollers 49 either to the downstream-side feed rollers 50 as shown by a solid line in FIG. 1, or to the reverse rollers 66 as shown by a broken line in FIG. 1. The flapper 65 is pivotally supported at the rear portion of the main casing 2 and pivotally moved upon energization or de-energization of a solenoid (not shown) for switching the feeding direction of the sheet 3.

The reverse rollers 66 comprise a pair of rollers. The reverse rollers 66 are positioned downstream of the flapper 65 and at an upper portion of the casing 64. Rotational directions of the reverse rollers 66 are changeable in both forward and reverse directions. The reverse rollers 66 are first rotated in the forward direction to direct the sheet 3 toward the reverse guide plate 68, and then rotated in the reverse direction to transport the sheet 3 in the reverse direction.

The re-circulation rollers 67 are positioned downstream of the reverse rollers 66 and are positioned immediately therebelow in the casing 64. The re-circulation rollers 67 include a pair of rollers to direct the sheet 3, reversely driven by the reverse rollers 66, toward the re-circulation tray 63.

The reverse guide plate 68 is shaped like a plate extending upwardly from an upper end portion of the casing 64. The reverse guide plate 68 guides the sheet 3 fed by the reverse rollers 66.

For printing an image on a back surface of the sheet 3 whose front surface has been formed with an image, the flapper 65 is switched to a position allowing the sheet 3 to be fed toward the reverse rollers 66. Thus, the sheet 3, whose front surface has been formed with an image, is received in the sheet reverse section 62. After the sheet 3 reaches the reverse rollers 66, the reverse rollers 66 are rotated in the forward direction for temporarily discharging the paper upwardly along the reverse guide plate 68. When a major part of the sheet 3 is fed out of the casing 64 and a trailing end portion of the sheet 3 is nipped between the reverse rollers 66, the rotation of the reverse rollers 66 in the forward direction is stopped. Then, the reverse rollers 66 are reversely rotated to feed the sheet 3 downwardly toward the re-circulation rollers 67.

A sheet sensor 76 is provided downstream of the fixing unit 23 for detecting the sheet 3. A reverse timing for changing the rotating direction of the reverse rollers 66 from the forward direction to the reverse direction is controlled such that the reverse timing occurs after the elapsing of a predetermined period starting from a detection timing at which the sheet sensor 76 detects a trailing edge of the sheet 3. Further, the flapper 65 is switched to its original posture, i.e., a posture allowing the sheet 3 to be fed to the downstream-side feed rollers 50 from the feed rollers 49 upon completion of feeding of the sheet 3 to the reverse rollers 66.

The sheet 3 reversely fed by the re-circulation rollers 67 is delivered to the re-circulation tray 63 by the re-circulation rollers 67. The re-circulation tray 63 has a sheet receiving portion 69, a tray 70, and diagonal feed rollers 71.

The sheet receiving portion 69 is externally attached to the main casing 2 at a position below the sheet reverse section 62, and has an arcuate sheet guide member 72. In the sheet receiving portion 69, the sheet 3, substantially vertically downwardly fed by the recirculation rollers 67 of the sheet reverse section 62, is reoriented to a substantially horizontal direction along the curvature of the sheet guide member 72 toward the tray 70.

The tray 70 has a rectangular plate-like shape, and is oriented in a horizontal direction above the sheet supply tray 6. An upstream end of the tray 70 is connected to the sheet guide member 72. A downstream end of the tray 70 is connected to a re-circulation path guide 73 that is joined to a sheet transport path in order to guide the sheet 3 from the tray 70 to the second conveying rollers 9.

Disposed at a sheet path on the tray 70 are two diagonal feed rollers 71 adapted to feed the sheet 3 in a direction for permitting the sheet 3 to be in abutment with a reference plate (not shown). The diagonal feed rollers 71 are spaced away from each other in the sheet feeding direction.

The diagonal feed rollers 71 are positioned near the reference plate provided at one widthwise edge area of the tray 70. Each diagonal feed roller 71 includes a diagonal feed drive roller 74 whose rotation axis extends substantially perpendicular to the sheet feeding direction, and a diagonal feed driven roller 75 in nipping relation to the diagonal feed drive roller 74. A rotation axis of the diagonal feed driven roller 75 extends in a slanting direction with respect to a direction substantially perpendicular to the sheet feeding direction, for allowing the sheet 3 to be brought into abutment with the reference plate.

The sheet 3 delivered from the sheet receiving portion 69 to the tray 70 moves toward the image forming portion, with the sheet 3 having been turned upside down, through the re-circulation path guide 73, while one widthwise edge of the sheet 3 is brought into a slidingly abutting relationship to the reference plate by the driving of the diagonal feed rollers 71. At the image forming portion, the back surface of the sheet 3 is in confrontation with the photosensitive drum 28 and a toner image is transferred to the sheet 3. The toner image is then fixed at the fixing unit 23. Thereafter, the sheet 3 having the images formed on both surfaces thereof is discharged onto the discharge tray 52.

As described above, in the laser printer 1 according to the embodiment, the charge amounts per unit area of toner (Q/A) before and after the toner carried on the surface of the developing roller 34 passes through the regulating blade 35 are not substantially changed. That is, the charge amounts Q1, Q2 at the first and second areas A1, A2 per unit area are substantially the same.

When the toner is rubbed between the toner supply roller 33 and the developing roller 34, the toner charge amount has nearly reached the level of saturation. The toner charging is less likely to occur when the toner carried on the developing roller 34 passes through the regulating blade 35. Accordingly, the countercharge is less likely to accumulate on the regulating blade 35. Thus, a thin layer of toner is stably formed on the developing roller 34.

The toner is sufficiently charged by friction between the toner supply roller 33 and the developing roller 34, so that the regulating blade 35 does not have to be pressed firmly against the developing roller 34. Therefore, wear or abrasion of the regulating blade 35 is prevented, leading to improvements in durability of the regulating blade 35 and in the image quality.

The charge control agent is dispersed over the surface of the toner base particles. Therefore, when the toner is rubbed between the toner supply roller 33 and the developing roller 34, the toner charging is promoted and the toner is charged to the proper polarity.

Although the invention has been described in detail and with reference to the specific embodiments thereof, it would be apparent to those skilled in the art that various changes, arrangements and modifications may be applied therein without departing from the spirit and scope of the invention.

What is claimed is:

1. An image forming apparatus, comprising:

an image holding member;

a developing agent holding member that holds a developing agent to be carried to the image holding member;

a supply member that supplies the developing agent to the developing agent holding member; and a regulating member, provided between the image holding member and the supply member, that forms a thin layer of the developing agent supplied by the supply member on the developing agent holding member, the regulating member defining a first region and a second region on the developing agent holding member, the first region being between the supply member and the regulating member in a rotating direction of the developing agent holding member, the second region being between the regulating member and the image holding member in the rotating direction of the developing agent holding member, wherein a charge amount per unit area of the developing agent at the first region is substantially equal to a charge amount per unit area of the developing agent at the second region.

2. The image forming apparatus according to claim 1, wherein the developing agent holding member is a developing agent holding roller rotatable in a direction, and wherein the supply member is a supply roller rotatable in the same direction as the developing agent holding roller, a surface of the supply roller contacting a surface of the developing agent holding roller.

3. The image forming apparatus according to claim 2, wherein a rotational speed of the supply roller is faster than a rotational speed of the developing agent holding roller.

4. The image forming apparatus according to claim 3, wherein the supply roller is made of urethane material.

5. The image forming apparatus according to claim 1, wherein the regulating member includes a pressing member, pressed on the developing agent holding member, made of insulation material.

6. The image forming apparatus according to claim 1, wherein the regulating member includes a pressing member, pressed on the developing agent holding member, the pressing member further comprising:

a contact portion that contacts the developing agent holding portion; and a guide portion that guides the developing agent to the contact portion.

7. The image forming apparatus according to claim 1, wherein a surface of the developing agent holding portion is made of a resin including fluorine.

8. The image forming apparatus according to claim 1, wherein the developing agent is formed in a substantially spherical shape.

9. The image forming apparatus according to claim 8, wherein a charge control material is dispersed around the developing agent.

10. An image forming apparatus, comprising:

an image holding member;

a developing agent holding member that holds a developing agent to be carried to the image holding member;

a supply member that supplies the developing agent to the developing agent holding member; and a regulating member, provided between the image holding member and the supply member, that forms a thin layer of the developing agent supplied by the supply member on the developing agent holding member, the regulating member defining a first region and a second region on the developing agent holding member, the first region being between the supply member and the regulating member in a rotating direction of the developing agent holding member, the second region being between the regulating member and the image holding member in the rotating direction of the developing agent holding member, wherein a charge amount per unit area (Q1) of the developing agent at the first region and a charge amount per unit area (Q2) of the developing agent at the second region satisfy the following formulas (1) and (2):

(1) $Q1 \leqq Q2 < 1.2 \times Q1$ at a time when solid black image formation is finished, and (2) $Q2 \leqq Q1 < 1.2 \times Q2$ at a time when solid white image formation is finished.

11. The image forming apparatus according to claim 10, wherein the developing agent holding member is a developing agent holding roller rotatable in a direction, and wherein the supply member is a supply roller rotatable in the same direction as the developing agent holding roller, a surface of the supply roller contacting a surface of the developing agent holding roller.

12. The image forming apparatus according to claim 11, wherein a rotational speed of the supply roller is faster than a rotational speed of the developing agent holding roller.

13. The image forming apparatus according to claim 12, wherein the supply roller is made of urethane material.

14. The image forming apparatus according to claim 10, wherein the developing agent is formed in a substantially spherical shape.

15. The image forming apparatus according to claim 14, wherein a charge control material is dispersed around the developing agent.

16. The image forming apparatus according to claim 10, wherein the regulating member includes a pressing member, pressed on the developing agent holding member, made of insulation material.

17. The image forming apparatus according to claim 10, wherein the regulating member includes a pressing member, pressed on the developing agent holding member, the pressing member further comprising:

a contact portion that contacts the developing agent holding portion; and a guide portion that guides the developing agent to the contact portion.

18. An image forming section removably mounted in an image forming apparatus, comprising:

a developing cartridge, having:

a toner hopper formed in the cartridge;

a rotatable toner feeding blade mounted in the toner hopper;

a toner supply roller that receives toner fed by the toner feeding blade and transporting the toner thereon;

a developing roller that contracts and receives toner from the toner supply roller; and a toner layer thickness regulating blade mounted to the cartridge to contact the developing roller at a position separated from the contact of the developing roller with the toner supply roller;

a photosensitive member cartridge, having a photosensitive member rotatably mounted therein, wherein the developing roller contacts the photosensitive member downstream, in a toner feed direction, of the layer thickness regulating the blade, a first distance between the contact between the toner supply roller and developing roller and the contact between the layer thickness regulating blade and the developing roller is less than a second distance between the contact of the layer thickness regulating blade and the developing roller and the contact between the developing roller and the photosensitive drum, and a charge amount per unit area (Q1) of the toner in a first area defined by the first distance times a length of the developing roller is substantially equal to a charge amount per unit area (Q2) of the toner in a second area defined by the second distance times the length of the developing roller.

19. The image forming section according to claim 18, wherein the charge amounts of the first area and the second area satisfy the following relationships:

$Q1 \leqq Q2 < 1.2 \times Q1$ at a time when solid black image formation is finished, and $Q2 \leqq Q1 < 1.2 \times Q2$ at a time when solid white image formation is finished.

20. The image forming section according to claim 18, wherein the toner supply roller and the developing roller rotate in the same direction to charge the toner.

21. The image forming section according to claim 18, wherein the developing cartridge and the photosensitive member cartridge are separately removable from the image forming apparatus.

* * * * *

UNITED STATES PATENT AND TRADEMARK OFFICE

CERTIFICATE OF CORRECTION

PATENT NO. : 6,917,781 B2
DATED : July 12, 2005
INVENTOR(S) : Shougo Sato

It is certified that error appears in the above-identified patent and that said Letters Patent is hereby corrected as shown below:

Column 14,
Line 50, insert the following:

-- 22. A developing device, comprising:

a developing agent holding member that holds a developing agent to be carried to an image holding member;

a supply member that supplies the developing agent to the developing agent holding member; and a regulating member, provided between the image holding member and the supply member, that forms a thin layer of the developing agent supplied by the supply member on the developing agent holding member, the regulating member defining a first region and a second region on the developing agent holding member, the first region being between the supply member and the regulating member in a rotating direction of the developing agent holding member, the second region being between the regulating member and the image holding member in the rotating direction of the developing agent holding member, wherein a charge amount per unit area of the developing agent at the first region is substantially equal to a charge amount per unit area of the developing agent at the second region.

23. The developing device according to claim 22, wherein the developing agent holding member is a developing agent holding roller rotatable in a direction, and wherein the supply member is a supply roller rotatable in the same direction as the developing agent holding roller, a surface of the supply roller contacting a surface of the developing agent holding roller.

24. The developing device according to claim 23, wherein a rotational speed of the supply roller is faster than a rotational speed of the developing agent holding roller.

25. The developing device according to claim 24, wherein the supply roller is made of urethane material.

26. The developing device according to claim 22, wherein the regulating member includes a pressing member, pressed on the developing agent holding member, made of insulation material.

27. The developing device according to claim 22, wherein the regulating member includes a pressing member, pressed on the developing agent holding member, the pressing member further comprising:

a contact portion that contacts the developing agent holding portion; and a guide portion that guides the developing agent to the contact portion.

28. The developing device according to claim 22, wherein a surface of the developing agent holding portion is made of a resin including fluorine.

It is certified that error appears in the above-identified patent and that said Letters Patent is hereby corrected as shown below:

Column 14 (cont'd),

29. The developing device according to claim 22, wherein the developing agent is formed in a substantially spherical shape.

30. The developing device according to claim 29, wherein a charge control material is dispersed around the developing agent.

31. A developing device, comprising:

a developing agent holding member that holds a developing agent to be carried to an image holding member;

a supply member that supplies the developing agent to the developing agent holding member; and a regulating member, provided between the image holding member and the supply member, that forms a thin layer of the developing agent supplied by the supply member on the developing agent holding member, the regulating member defining a first region and a second region on the developing agent holding member, the first region being between the supply member and the regulating member in a rotating direction of the developing agent holding member, the second region being between the regulating member and the image holding member in the rotating direction of the developing agent holding member, wherein a charge amount per unit area (Ql) of the developing agent at the first region and a charge amount per unit area (Q2) of the developing agent at the second region satisfy the following formulas (1) and (2):

(1) $Q1 \leq Q2 < 1.2 \times Q1$ at a time when solid black image formation is finished, and (2) $Q2 \leq Q1 < 1.2 \times Q2$ at a time when solid white image formation is finished.

32. The developing device according to claim 31, wherein the developing agent holding member is a developing agent holding roller rotatable in a direction, and wherein the supply member is a supply roller rotatable in the same direction as the developing agent holding roller, a surface of the supply roller contacting a surface of the developing agent holding roller.

33. The developing device according to claim 32, wherein a rotational speed of the supply roller is faster than a rotational speed of the developing agent holding roller.

34. The developing device according to claim 33, wherein the supply roller is made of urethane material.

35. The developing device according to claim 31, wherein the developing agent is formed in a substantially spherical shape.

36. The developing device according to claim 35, wherein a charge control material is dispersed around the developing agent.

CERTIFICATE OF CORRECTION

PATENT NO. : 6,917,781 B2
DATED : July 12, 2005
INVENTOR(S) : Shougo Sato

It is certified that error appears in the above-identified patent and that said Letters Patent is hereby corrected as shown below:

Column 14 (cont'd),

37. The developing device according to claim 36, wherein the regulating member includes a pressing member, pressed on the developing agent holding member, made of insulation material.

38. The developing device according to claim 31, wherein the regulating member includes a pressing member, pressed on the developing agent holding member, the pressing member further comprising:

a contact portion that contacts the developing agent holding portion; and a guide portion that guides the developing agent to the contact portion.

39. A cartridge detachably attachable to an image forming apparatus, comprising:

a developing agent holding member that holds a developing agent to be carried to an image holding member;

a supply member that supplies the developing agent to the developing agent holding member; and a regulating member, provided between the image holding member and the supply member, that forms a thin layer of the developing agent supplied by the supply member on the developing agent holding member, the regulating member defining a first region and a second region on the developing agent holding member, the first region being between the supply member and the regulating member in a rotating direction of the developing agent holding member, the second region being between the regulating member and the image holding member in the rotating direction of the developing agent holding member, wherein a charge amount per unit area of the developing agent at the first region is substantially equal to a charge amount per unit area of the developing agent at the second region.

40. A cartridge detachably attachable to an image forming apparatus, comprising:

a developing agent holding member that holds a developing agent to be carried to an image holding member;

a supply member that supplies the developing agent to the developing agent holding member; and

UNITED STATES PATENT AND TRADEMARK OFFICE

CERTIFICATE OF CORRECTION

PATENT NO. : 6,917,781 B2
DATED : July 12, 2005
INVENTOR(S) : Shougo Sato

It is certified that error appears in the above-identified patent and that said Letters Patent is hereby corrected as shown below:

Column 14 (cont'd), a regulating member, provided between the image holding member and the supply member, that forms a thin layer of the developing agent supplied by the supply member on the developing agent holding member, the regulating member defining a first region and a second region on the developing agent holding member, the first region being between the supply member and the regulating member in a rotating direction of the developing agent holding member, the second region being between the regulating member and the image holding member in the rotating direction of the developing agent holding member, wherein a charge amount per unit area (Q1) of the developing agent at the first region and a charge amount per unit area (Q2) of the developing agent at the second region satisfy the following formulas (1) and (2):

(1) $Q1 \leq Q2 < 1.2 \times Q1$ at a time when solid black image formation is finished, and (2) $Q2 \leq Q1 < 1.2 \times Q2$ at a time when solid white image formation is finished. --.

Signed and Sealed this

First Day of November, 2005

JON W. DUDAS
*Director of the United States Patent and Trademark Office*